United States Patent [19]

Janko et al.

[11] Patent Number: 4,972,971

[45] Date of Patent: Nov. 27, 1990

[54] AUTOMATIC INFLATOR FOR INFLATABLE ARTICLES

[75] Inventors: Michael Janko, Richmond; Ray Moran, Grosse Pointe Farms; Norman Carlson; Judy Moran, both of Rochester, all of Mich.

[73] Assignee: Inflation Technologies & Innovation

[21] Appl. No.: 373,207

[22] Filed: Jun. 29, 1989

[51] Int. Cl.[5] ..... B67B 7/24

[52] U.S. Cl. ..... 222/5; 222/41; 222/63; 222/81; 222/83; 441/93; 441/94

[58] Field of Search ..... 222/3, 5, 41, 63, 54, 222/81, 83; 441/92, 93, 94, 95

[56] References Cited

U.S. PATENT DOCUMENTS

| | | | |
|---|---|---|---|
| 1,329,990 | 2/1920 | Müller . | |
| 2,527,605 | 10/1950 | Walk . | |
| 2,627,998 | 2/1953 | Musser et al. . | |
| 2,675,143 | 4/1954 | Seemann, Jr. . | |
| 2,701,886 | 2/1955 | Ivie . | |
| 2,894,658 | 7/1959 | Spidy . | |
| 2,904,217 | 9/1959 | Gurney . | |
| 2,944,268 | 7/1960 | Fruendt . | |
| 2,964,050 | 12/1960 | Novak . | |
| 3,059,814 | 10/1962 | Poncel et al. . | |
| 3,077,288 | 2/1963 | Henry . | |
| 3,090,979 | 5/1963 | Segrest . | |
| 3,127,624 | 4/1964 | Kubit et al. . | |
| 3,193,140 | 7/1965 | Trauger . | |
| 3,198,384 | 8/1965 | Anderson . | |
| 3,221,932 | 12/1965 | Anderson . | |
| 3,242,514 | 3/1966 | Waters . | |
| 3,266,668 | 8/1966 | Davis . | |
| 3,308,494 | 3/1967 | Licher . | |
| 3,350,730 | 11/1967 | Kubit et al. . | |
| 3,426,942 | 2/1969 | McMains et al. | 222/5 |
| 3,494,506 | 2/1970 | Fujimoto | 222/5 |
| 3,510,025 | 5/1970 | Turner, Jr. | 222/5 |
| 3,526,339 | 9/1970 | Bernhardt et al. | 222/5 |
| 3,630,413 | 12/1971 | Beckes et al. | 222/5 |
| 3,682,354 | 8/1972 | Witte | 222/3 |
| 3,693,202 | 9/1972 | Ohtani . | |
| 3,716,882 | 2/1973 | Middleton, Jr. et al. . | |
| 3,802,012 | 4/1974 | Middleton, Jr. . | |
| 3,812,546 | 5/1974 | Witte | 222/3 X |
| 3,815,783 | 6/1974 | Hirata | 222/5 |
| 3,833,029 | 9/1974 | Munn | 222/3 X |
| 3,910,457 | 10/1975 | Sutliff et al. | 222/5 |
| 3,934,292 | 1/1976 | Mulderrig | 222/5 X |
| 3,997,079 | 12/1976 | Niemann | 222/5 |
| 4,094,028 | 6/1978 | Fujiyama et al. | 222/3 X |
| 4,191,310 | 3/1980 | Bernhardt et al. | 222/5 |
| 4,223,805 | 9/1980 | Mackal | 222/5 |
| 4,246,672 | 1/1981 | Fujiyama et al. | 222/3 X |
| 4,260,075 | 4/1981 | Mackal | 222/5 |
| 4,267,944 | 5/1981 | Mackal | 222/5 |
| 4,475,664 | 9/1984 | Mackal | 222/5 |
| 4,482,081 | 11/1984 | Meggs | 222/5 |
| 4,493,664 | 1/1985 | Dale | 441/7 |
| 4,498,604 | 2/1985 | Mackal | 222/5 |
| 4,498,605 | 2/1985 | Mackal et al. | 222/5 |
| 4,500,014 | 2/1985 | Zimmerly | 222/5 |
| 4,524,885 | 6/1985 | Zimmerly | 222/5 |
| 4,629,436 | 12/1986 | Stewart et al. | 441/93 |

*Primary Examiner*—Joseph J. Rolla
*Assistant Examiner*—David H. Bollinger

[57] ABSTRACT

An inflator for automatically inflating an inflatable article, such as a personal flotation vest, upon immersion in water. A plunger is movably mounted within a housing and is movable with respect to a pressurized gas canister attached to the housing. An internally resettable automatic actuator mechanism, mounted within the housing, acts on the plunger to move the plunger to pierce the canister to release the pressurized gas therefrom through the housing to the inflatable article attached to the housing. A pair of spaced water sensor probes mounted in the housing provide a signal to a control device indicating that the housing is immersed in water. The control device activates the automatic actuator mechanism to release a spring-biased ram from a latched position such that the ram engages and urges the plunger under force into the sealed end of the gas canister. The automatic actuator mechanism, in a preferred embodiment, includes a motor actuated by the control device and gears which couple the motor output shaft to a slider which latches the ram in a retracted position. A manual lanyard is extensibly mounted within the housing and includes a cam which acts on the plunger to manually urge the plunger into the gas canister when the lanyard is extended outward from the housing.

19 Claims, 2 Drawing Sheets

AUTOMATIC INFLATOR FOR INFLATABLE ARTICLES

CROSS REFERENCE TO RELATED APPLICATIONS

This application is related to copending U.S. patent application Ser. No. 07/359,875, filed May 30, 1989, in the names of M. Janko and M. McAllister for an Automatic Inflator for Inflatable Articles and assigned to the same assignee as the subject application.

BACKGROUND OF THE INVENTION

Field of the Invention

The present invention relates, in general, to inflatable articles and, more specifically, to inflators for inflatable articles, such as personal flotation devices, life vests, rafts, etc.

Personal flotation devices (PFDs), commonly known as life vests or jackets, and other inflatable articles, such as rafts, etc., have been devised to inflate and serve as a flotation device for a person immersed in water. Such devices typically employ a pressurized gas canister or cylinder, such as a carbon dioxide cylinder, which, when pierced, releases gas to inflate the attached article. A manual operating lever or lanyard is employed to move a spring biased pin into the gas canister to pierce and release the gas therefrom.

While such devices are effective, such manually operated inflators require the use of energy by the wearer to activate the inflator to release the gas to inflate the article. If the wearer is disabled or unconscious, he is unable to actuate the inflator to inflate the article.

To overcome such a problem, automatic inflators have been devised which singly, or in combination with a manual lanyard, automatically inflate a vest or raft when immersed in water. Such automatic inflators typically include a pill or a member formed of a material which is responsive to water and which dissolves or changes in volume or dimension when subject to water. The pill or member, when altered, releases a spring-loaded striker or plunger to pierce the gas canister and release the gas therefrom to inflate the attached article. In other such devices, the disintegration of the pill or member upon exposure to moisture or water causes a explosive charge to detonate to actuate the canister piercing pin.

While such actuators automatically inflate articles without manual intervention, they are not without their deficiencies. Such actuators take a measurable amount of time, i.e., several seconds, for the pill to disintegrate before actuating the device to release the gas and inflate the article. This time delay may be critical in certain uses to prevent injury or drowning of the wearer of the inflatable article. Further, such automatic inflators are relatively unreliable in that they have been proven to operate only two-thirds of the time when exposed to water. Further, such automatic inflators provide little or no ready indication of a fully charged gas canister. Such inflators also provide no indication of an operative inflator.

Improved automatic inflators have been devised which utilize probes or conductors mounted in the inflator body and which form a part of an electrical circuit used to automatically drive a plunger into the pressurized gas canister. When the housing is fully immersed in water, a circuit is closed between the probes which supplies electric power to an actuating mechanism, i.e., such as an explosive charge which detonates to drive the plunger into the canister. While such inflators are an improvement over previous)y devised automatic inflators, care must be taken to prevent premature actuation due to a splash of water when the housing is not fully immersed in water. Further, such improved automatic inflators still provide no indication of a spent or empty gas canister nor the operative state of the inflator actuating mechanism.

Further, such previously devised inflators require the replacement of certain parts, such as the water soluble member or the detonator before they can be used again. This adds to the cost of the inflator and minimizes its efficient usage over a long period of time.

Thus, it would be desirable to provide an automatic inflator for inflatable articles which automatically inflates an inflatable device without user intervention. It would also be desirable to provide an automatic inflator which quickly inflates an inflatable article when immersed in water. It would also be desirable to provide an automatic inflator which can be internally reset for successive operations without the need for replacing spent parts. Finally, it would be desirable to provide an automatic inflator for inflatable articles which provides an easily visible indication of the condition of the gas canister, i.e., whether charged or pierced, as well as the operative state of the inflator actuating mechanism.

SUMMARY OF THE INVENTION

The present invention is an automatic inflator for inflatable articles which automatically releases pressurized gas to inflate such articles upon immersion in water. The inflator includes a housing having means for discharging pressurized gas to the inflatable article. A pressurized gas canister is removably attached to the housing and is disposed in fluid flow communication with the gas discharging means in the housing. A plunger is movably mounted within the housing with respect to and facing the gas canister. The plunger is provided with a canister piercing end.

An electrical power source is mounted in the housing and is connected to a water sensor means, also mounted on the housing. The water sensor means detects immersion of the housing in water and outputs a signal to a control means.

A ram is slidably mounted in the housing and is movable between a first, retracted position and a second, extended position in which the ram acts on the plunger to drive the plunger into the canister. A first biasing means is mounted in the housing for biasing the ram toward the second extended position.

An internal, resettable automatic actuating means is provided to release the ram to the second, extended position to drive the plunger into the canister when the inflator is immersed in water. In a preferred embodiment, the automatic actuating means comprises a latching means for latching the ram in the first, retracted position. Preferably, the latching means comprises a slider movably disposed within the housing and movable between a first position in which the slider latches the ram in the first, retracted position against the bias of the first biasing means and a second position wherein the slider is disengaged from the ram enabling the ram to move under the bias of the first biasing means into engagement with the plunger to drive the plunger into the canister under the biasing force of the first spring means.

The automatic actuating means is internally resettable by means of a third biasing means acting on the ram to bias the ram to the first, retracted position and a cap means which is threadingly mountable on the housing. The first biasing means is disposed between the ram and the cap means and is compressed when the cap is threaded onto the housing. After the actuating means actuates the ram to drive the piercing pin into the canister, the cap may be backed off or unthreaded a few turns to enable the third biasing means to urge the ram to the first, retracted position. This automatically resets the ram for a subsequent operation.

In a preferred embodiment, a motor is mounted within the housing and is connected to a control means, as described hereafter. The motor has an output shaft coupled by a gear means to the slider. Thus, activation of the motor causes rotation of the motor outPut shaft which, through the gear means, moves the slider between the first and second positions.

The inflator of the present invention also includes a control means, preferably a central processing unit, which is connected to and responsive to the water sensor means. The control means controls the actuation of the motor in response to an output from the water sensor means. In addition, manual operating means is mounted in and extends outward from the housing for manually driving the plunger into the canister when the exterior end of the manual operating means is extended or pulled from the housing.

In a preferred embodiment, the inflator of the present invention includes means for detecting the position of the plunger to provide an indication of the operative state of the gas canister. In this manner, a ready indication through a visible indicator mounted on the housing is provided to indicate whether the canister is fully charged or has been pierced and is empty. Additional indicators are also provided in the housing and driven by the control means to indicate the operative state of the inflator insofar as having sufficient electrical power to automatically activate the inflator, as well as provide an indication of any internal fault condition whIch would prevent the operation of the inflator.

The inflator of the present invention automatically inflates an inflatable article attached thereto with pressurized gas immediately upon immersion in water. The water sensor probes are mounted in the housing in such a manner as to prevent their activation in generating an output signal due only to a splash or a momentary contact with water. This requires that the sensor be fully immersed in water before generating an output signal to activate the inflator.

The inflator includes both automatic, as well as manual activating means. Most importantly, the inflator of the present invention provides visible indication of the state of the gas canister, i.e., whether fully charged or empty. In addition, the control means drives several indicators which provide a visible indication of the operative state of the inflator with regard to electrical power levels sufficient to activate the inflator, as well as the presence of any fault condition which would prevent the operation of the inflator in an automatic mode.

BRIEF DESCRIPTION OF THE DRAWING

The various features, advantages and other uses of the present invention will become more apparent by referring to the following detailed description and drawing in which.

DESCRIPTION OF THE PREFERRED EMBODIMENTS

Figure 1:
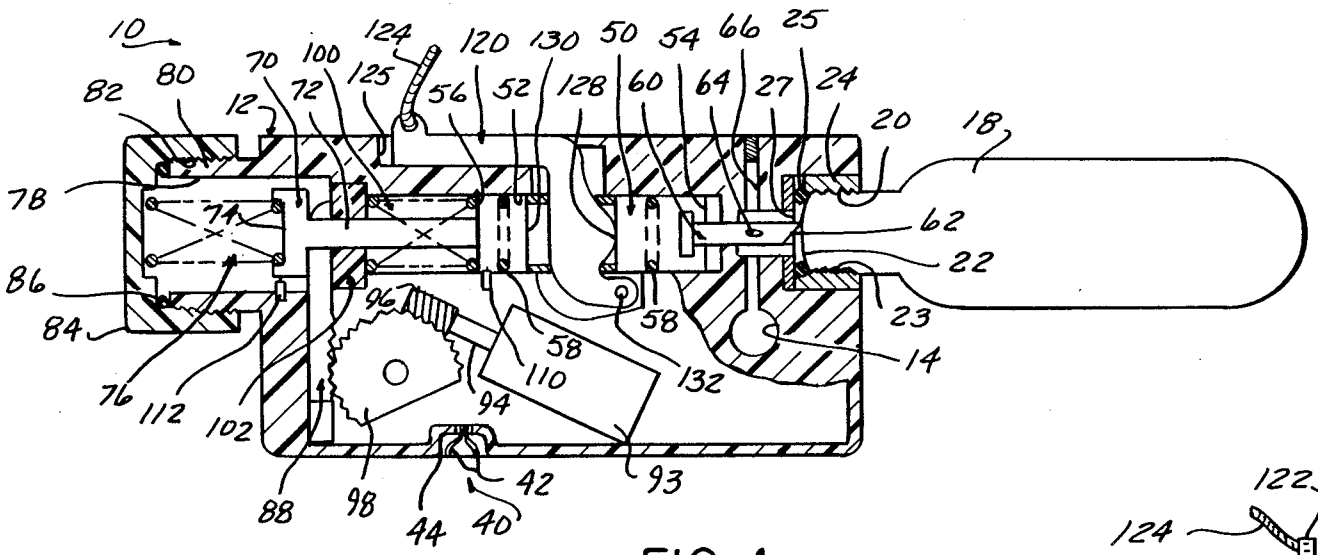
FIG. 1 is a front elevational view, partially broken away, of an automatic inflator constructed in accordance with the teachings of the present invention.

Throughout the following description and drawing, an identical reference number is used to refer to the same component shown in multiple figures of the drawing.

Figure 2:
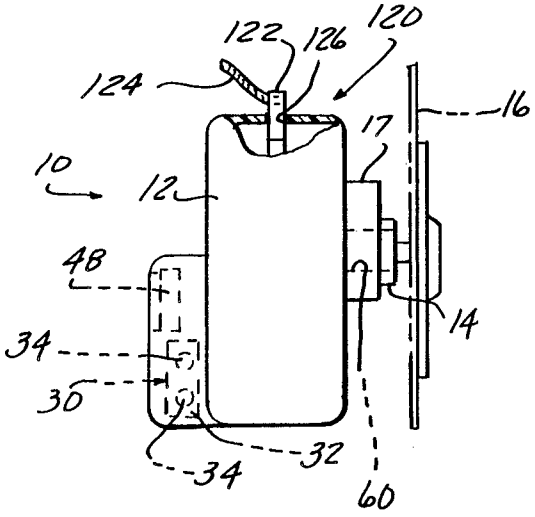
FIG. 2 is a left side elevational view of the inflator shown in FIG. 1 showing the attachment of the inflator to an inflatable article.

Referring now to the drawing, and to FIGS. 1 and 2, in particular, there is illustrated an inflator 10 for inflating an inflatable article 16, such as a personal flotation device, raft, etc. The inflatable article 16 with which the inflator 10 is used may comprise any type of article which is inflated by pressurized gas released from the inflator 10.

The inflator 10 includes a waterproof housing 12, preferably formed of a plastic material. The housing 12 is hollow or has portions bored throughout for receiving the various components, described below, which form the operative elements of the inflator 10. Suitable seals may also be provided to mount the water sensor and the gas canister, as described hereafter, on the housing 12 and to make the housing 12 waterproof.

As shown in FIGS. 1 and Z, the housing 12 is connected by a suitable fluid flow conduit 14 to the inflatable article 16. Any suitable mounting means, such as a quick release valve 17, may be employed to attach the inflator housing 12 to the inflatable article 18 and such mounting means may be permanent or removable.

The pressurized gas canister 18 which is attached to the housing 12 may he any conventional pressurized gas canister, such as one containing carbon dioxide ($CO_2$) or any other fluid commonly employed to inflate an inflatable article 18. The canister 18 is preferably in the form of a metal container having a threaded end portion 20 formed adjacent one end and a piercible end portion 22 situated within the threaded end portion 20 and facing outward from one end of the canister 18. The threads 20 on one end of the canister 18 are threadingly received in a threaded bore 23 formed in a threaded metallic insert 24 molded or otherwise mounted in housing 12. A face seal 25 is mounted in the insert 24 to prevent gas from escaping exteriorly from the housing 12 and to prevent water from entering the housing 12. An aperture 27 is formed in one end of the insert 24 to receive the piercing rod, as described in detail hereafter.

An electric power source, denoted generally by reference number 30 in FIG. 1, is mounted within the housing 12 and provides electrical power to the electrically operated components of the inflator 10. The electric power source 30 comprises one or more storage batteries 32. The batteries 32 have contacts 34 which engage mating contacts mounted within the housing 12.

In a preferred embodiment, the electric power source 30 is removably insertable into the housing 12 through a suitable cap or cover, not shown. This enables the batterIes 82 to be replaced when their energy has been depleted. The cover may be formed as a snap-on attachment to the housing 12 or may be connected to the housing 12 by threads. Alternately, the batteries 32 are molded to the housing in a non replaceable manner.

Water sensor means, denoted by reference number 40, is mounted in the housing 12. Preferably, the water sensor means 40 comprises a pair of electric probes 42, which are in the form of thin metallic strips, mounted in a recess 44 formed in one portion of the housing 12. The probes 42 extend outward from the interior of the housing 12 and are completely surrounded by the peripheral extent of the recess 44. This prevents a splash or a drop of water from forming a conductive path between the probes 42 which would inadvertently activate the inflator 10. The electric power source 30 and the water sensor means 40 are electrically connected to a control means 46, shown generally in FIG. 1, and in detail in FIG. 5. The control means 46 is mounted on a circuit board 48 mounted within the housing 12.

Figure 5:
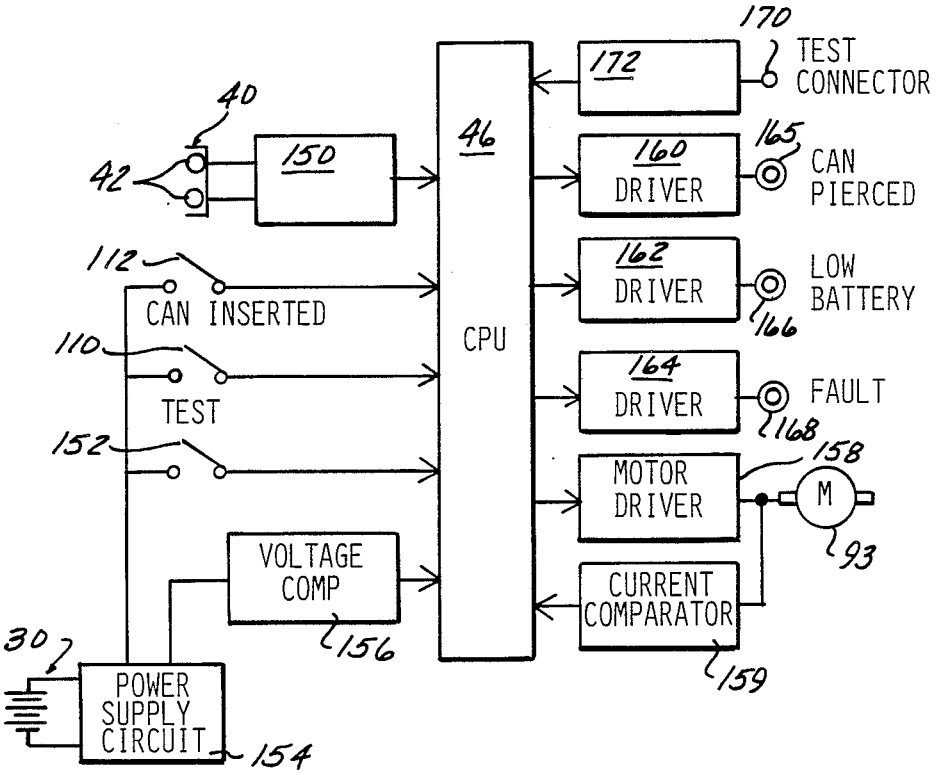
FIG. 5 is a schematic block diagram of the electrical circuitry of the control means of the inflator of the present invention.

The control means 46 may comprise any type of electric circuit suitable for activating the inflator in response to immersion of the water sensor means 40 in water. Thus, a discrete component electronic circuit may be employed. In a preferred embodiment, however, the control means 46 comprises a central processing unit, such as a National Semiconductor microcomputer model No. NSCOP413SC, which executes a stored program and activates the inflator in response to an input from the water sensor means 40. As shown in FIG. 5, the control means 46 receives as one input the output from the water sensor means 40.

Figure 4:
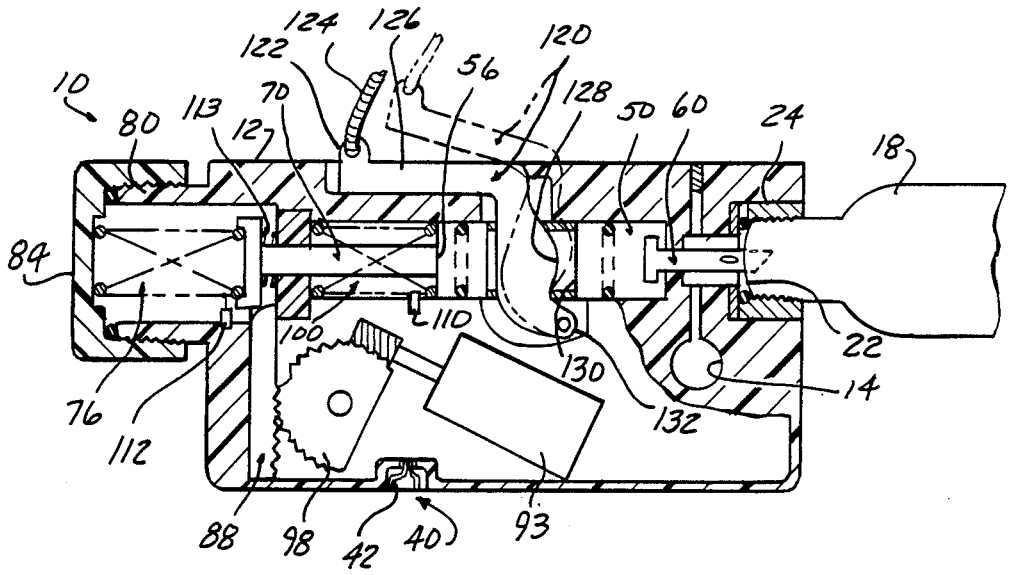
FIG. 4 is a front elevational view, similar to FIG. 1, but showing the position of the plunger, ram and slider after the inflator has been actuated.

A plunger 50, shown in FIGS. 1 and 4, is slidably mounted within a bore 52 formed within the housing 12. The plunger 50 has a generally tubular shape with first and second ends 54 and 56. Seal means, such as O-rings 58, are mounted in the exterior surface of the plunger 50 to seal the bore 52.

A piercing rod 60 is mounted at the first end 54 of the plunger 50 and extends outward therefrom. The piercing rod has a generally tubular form and terminates in a piercing end 62 which is adapted to engage and pierce the sealed end 22 of the gas canister 18. Preferably, the piercing rod 60 is in the form of a roll pin having an aperture or slot 64 formed along its length which communicates with a hollow interior passage formed within the piercing rod 60 and opening through the piercing end 62.

A transverse bore 66 extends through the housing 12 and communicates with the fluid outlet 14. One end of the bore 86 is plugged, as shown in FIGS. 1 and 4. In this manner, gas released from the canister 18 flows through the piercing rod 60, through the aperture 64 in the piercing rod 60 and into the bore 66 from which it flows through the outlet 14 to the inflatable article 16 attached to the housing 12.

The inflator 10 of the present invention also includes internally resettable automatic actuating means for automatically driving the plunger 50 into the gas canister 18 when the housing 12 is immersed in water, as detected by the water sensor means 40. A ram 70 is slidably mounted within the housing 12 and includes an elongated rod portion 72 which acts on the second end 56 of the plunger 50. The rod portion 72 of the ram 70 extends into the bore 52 in the housing 12. One end portion of the ram 70 is enlarged and forms a seat 74 for a first biasing means 76. The first biasing means 76 is preferably in the form of a coil spring. The first biasing means 76 is disposed within an enlarged bore 78 formed in a boss 80 extending outward from one end of the housing 12. External threads 82 are formed on the boss 80 and engage threads formed on a cap 84 which is sealingly engageable with the boss 80. A seal 86, such as an 0-ring, is carried by the cap 84 for sealing the housing 12 when the cap 84 is attached thereto. The distance that the cap 84 is threaded onto the boss 80 determines the compression of the first biasing means or spring 76 as will become more apparent in the following description.

The first biasing means 76 acts on the ram 70 and is adapted to move the ram 70 between a first, retracted position, shown in FIG. 1, and a second, extended position, shown in FIG. 4. While moving to the second, extended position, shown in FIG. 4, the ram 70 drives the plunger 50 toward the gas canister 18 under force such that the piercing end 62 of the piercing rod 60 attached to the plunger 60 pierces the sealed end 22 of the gas canister 18 releasing pressurized gas therefrom.

The automatic actuating means also includes means for latching the ram 70 in the first, retracted position, shown in FIG. 1. Preferably, the latching means, denoted by reference number 88, is a slider, shown in FIGS. 1 and S. The slider 88 is preferably in the form of a planar member having an open ended U-shaped slot 90 formed at one end between two spaced arms 91. The slot 90 is adapted to engage the rod portion 72 of the ram 70 and abut the face 71 of the enlarged end portion of the ram 70 so as to latch and hold the ram 70 in the first, retracted position shown in FIG. 1.

Figure 3:
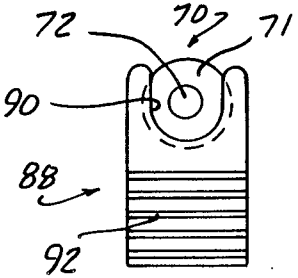
FIG. 3 is a partial, side elevational view of the slider shown in FIG. 1.

One surface of the slider 88 is formed with a plurality of spaced gear teeth 92, as shown in FIG. 3. The slider 88 is movable between a first position, shown in FIG. 1, in which the slider 88 engages the ram 70 and latches the ram 70 in the first, retracted position, shown in FIG. 1, and a second position, shown in FIG. 4, in which the U-shaped slot 90 in the slider 88 is disengaged from the ram 70 allowing sliding movement of the ram 70 under the bias of the first biasing means 76.

A bi-directional electrical motor 93, shown in FIG. 1, is mounted within the housing and includes a rotatable output shaft 94. Gear means couples the output shaft 94 of the motor 93 with the slider 88 to control the sliding movement of the slider 88 between the first and second positions.

By way of example only, the gear means coupling the motor 93 with the slider 88 include a worm gear 96 mounted on the end of the output shaft 94 of the motor 93 and a sector gear 98 pivotally mounted within the housing 19 and engageable with the worm gear 96. The sector gear 98 also engages the gear teeth 92 on the slider 88. Thus, actuation of the motor 93 and rotation of the output shaft 94 is translated into sliding movement of the slider 88 between the first and second positions, depending upon the direction of rotation of the output shaft 94 of the motor 93.

A second biasing means 100, such as a coil spring, is mounted within the bore 52 in the housing 12 and acts upon the second end 56 of the plunger 50. The other end of the second biasing means 100 acts upon a shoulder 102 formed in the housing 12 and situated at one end of the bore 52. The second biasing means 100 biases the plunger 50 toward the canister 18 and is provided with sufficient spring force to bring the piercing end 62 of the piercing rod 60, attached to the plunger 50, into contact with, but not piercing, the sealed end 22 of the gas canister 18. The spring force of the second biasing means 100 may be selected to supply a portion of the force required to pierce the gas canister 18 in conjunction with the force provided by the first biasing means 76, as described hereafter.

Insertion of a sealed gas canister 18 into the housing 12 will urge the plunger 50 to the left, in the orientation viewed in FIG. 1, against the bias provided by the second biasing means 100 until the plunger 50 reaches the position shown in FIG. 1. In this position, the piercing end 62 of the piercing rod 60 is in engagement with the sealed end 22 of the gas canister 18.

It will be understood that the above description of the automatic actuating means is by way of example only as other actuating means may be employed to mechanically drive the plunger into the canister. Thus, an electromechanical solenoid, a spring/solenoid combination, a linear motor or a pivotal toggle linkage, each responsive to the control means when a signal is received from the water sensor, may also be employed in the inflator of the present invention.

As shown in FIG. 1, a plunger position detector means 110 is mounted within the housing 12 to detect the position of the plunger 50. The position detector means 110 is preferably a switch, such as a limit switch or a proximity switch. The detector means 110 provides an indication that the plunger 50 is in its retracted position, such as when a sealed gas canister 18 is attached to the housing 12. As noted above, the insertion of a sealed gas container or canister 18 into the housing 12 urges the piercing rod SO and the plunger 50 to the left, as viewed in FIG. 1, against the bias of the second biasing means 100 until the plunger 50 reaches a retracted position, shown in FIG. 1. The position detector 110 detects the retracted position of the plunger 50 and provides a suitable output to the control means 46, as described hereafter, indicated of this state.

Whenever the inflator 10 has been automatically or manually activated, such that the plunger 50 has been urged to the right to pierce the gas canister 18 or when an unsealed gas canister 18 having an open end 22 is mounted in the housing 12, the plunger 50 will be biased to the right under the biasing effect of the second biasing means 100 to the position shown in FIG. 4. The position detector 110 will not be made and thus will indicate an advanced or ex&ended position of the plunger 50.

A second position detector 112 is also mounted within the housing 12 and detects the position of the ram 70 when the ram 70 Is in a retracted position, as shown in FIG. 1. When the ram 70 is in the retracted position shown in FIG. 1, the position detector 112 will generate an output indicating that the ram 70 has been retracted and is in a ready position. Whenever the ram 70 has been moved to its extended position, shown in FIG. 4, the position detector 112 will not be made so as to also provide an indication of the position of the ram.

In order to reset the inflator 10 for a subsequent operation after a canister 18 has been pierced or when loading a sealed canister 18 into the housing 12 for the first time, the cap 84 is backed off several turns from its full on position to release the compression of the first spring 76. A third biasing means or spring 113 having a spring force less than that of the first spring 76 is mounted in the housing 12 between the shoulder 102 and the face 91 of the enlarged end portion of the ram 70 and coaxially surrounds the rod portion 72 of the ram 70.

When the cap 84 is backed off a few turns, the third spring 113 will urge the ram 70 to the left, as viewed in FIG. 1, to its first, retracted position. The position detector 112 will be made when the ram 70 reaches the first, retracted position and sends a signal to the control means 46. The control means 46 then activates the motor 93 to move the slider 88 through the gear means to its extended position engaging and latching the ram 70 in the retracted position. The cap 84 is then tightened on the boss 80 to compress the first spring 76. It should he noted that the resetting operation described above can be performed at any time before a sealed, fully charged canister 18 is inserted into the housing 12.

The term "internally resettable" as applied to the automatic actuating means of the inflator 10 covers an actuating means which can be reset for subsequent operation for piercing another sealed canister mounted in the inflator 10 without the need for replacement of internal parts. The internal resetting function is achieved by the interaction of the first and third biasing means 76 and 113, respectively, and the cap 76 as described above.

As shown in FIGS. 1, 2 and 4, the inflator 10 is also provided with manual actuating means for manually moving the plunger 50 toward and piercing the gas canister 18. In a preferred embodiment, the manual actuating means comprises a single-piece lanyard 120 which is pivotally mounted within the housing 12. The lanyard 120 has a first end portion 122 extending outward through a slot 125 formed in the housing 12. An extensible cord 124 is attached to the first end portion 122 for pivoting the lanyard 120, as described hereafter. A planar arm 126 extends integrally from the first end of the lanyard 122 to an arcuate-shaped cam 128. The cam 128 is situated within an internal bore in the housing 12 and acts on the plunger 50 to urge the plunger 50 toward the gas canister 18.

As shown in FIGS. 1 and 4, the cam 128 of the lanyard 120 is disposed within a slot 130 formed within the plunger 150. The second end 132 of the lanyard 120 extending from the cam 128 is pivotally mounted to the housing 12.

In an inoperative position, the lanyard 120, as shown in FIG. 1, is situated within the housing 12 such that only the first end portion 122 extends outward from the housing 12. When the extensible cord 124 is pulled, the lanyard 120 pivots about the second end 132 to a position shown in phantom in FIG. 4. This pivotal movement urges the cam 128 into engagement with the face 130 in the bore in the plunger 50 urging the plunger 50 to the right, as shown in FIGS. 1 and 4, until the piercing rod 60 pierces the sealed end 22 of the canister 18 to release the pressurized gas therefrom. Release of the cord 124 causes a pivotal movement of the lanyard 120 in a reverse or counter-clockwise direction until the lanyard 120 assumes the normal position shown in FIG. 1.

FIG. 5 depicts a schematic block diagram of the control circuitry employed in the inflator 10 of the present invention. As shown therein, the control means or central processing unit 46 receives an output signal from the water sensor means 40 which has been conditioned by suitable signal conditioning circuitry 150, Motorola Model Nos. MMBD7000 and MMBD2826, for example, to the proper voltage level. Also input to the control means 46 are the detector means 110 and 112 which detect the position of the plunger 50 and the ram 70. A test input switch 152 is mounted on the housing 12 and is connected as an input to the control means 46 for initiating a self-test program stored within the control means 46. The self-test program exercises the inflator 10 and runs the inflator 10 through a partial cycle to detect if the motor 93 is stalled or is prevented from moving the slider 88. The electrical power source 30 supplies power to the switches 110, 112 and 152, as well as the water sensor means 40 through a power supply circuit 154 providing a regulated voltage output. The output of the power supply circuit 154 is also input through a voltage comparator 158, Intersil Model No. ICL 7665, to the control means 46.

The outputs from the control means 48 include a motor driver circuit 158, Sprague Model No. UDN-2592, which drives the motor 93. The output of the motor driver circuit 158 is input to a current comparator 159, such as of an amp, to detect a motor stalled condition, as described above. Suitable driver circuits 160, 162 and 164, Siliconix Model No. ZN7004 FET, are provided for status indicators 165, 166 and 168. The status indicator 165 indicates when the canister 18 is pierced, as detected by the position detector 110 status indicator 166, which is identical to the indicator 165, is mounted within the housing 12 and is visible exteriorly therefrom, as shown in FIG. 2. The status indicator 166 provides an indication of low electrical power source. The status indicator 168 is also identically constructed as the indicators 165 and 166 and is activated to indicate a fault condition when the control means 46, when executing the self-test program, encounters a fault stale which would indicate that the inflator 10 is non-operative or cannot function properly.

Finally, a test connector input 170 is connected through suitable conditioning circuitry 172, Motorola Model Nos. MMBD7000 and MMBD2836, as an input to the control means 46 for connecting a test connector to the control means 46. This enables the control means 46 to be tested during assembly or at any time during its use for proper operation.

The indicators 165, 166 and 168 may comprise any suitable type of indicator means, such as a magnetizable, switchable element carrying colored facia indicia, LEDs or a liquid crystal display.

In summary, there has been disclosed a unique inflator for inflatable articles which automatically inflates such articles upon immersion in water. The inflator is also manually actuated by means of manually operable lanyard. The inflator uniquely provides an indication of the condition of a pressured gas canister and provides a visible indication of whether the canister is sealed, thereby indicating a fully pressurized canister, or if it has been pierced and is therefore empty. This enables the operative state of the inflator to be easily detected at any time during storage and prior to use.

What is claimed is:

1. An inflator for inflatable articles comprising:

a housing;

means, formed in the housing, for discharging gas therefrom;

a pressurized gas canister attached to the housing and disposed in fluid flow communication with the gas discharging means;

a plunger movably mounted within the housing with respect to and facing the canister, the plunger having a canister piercing end;

an electrical power source mounted within the housing;

water sensor means, mounted within housing and extending partially outward therefrom, for generating an output signal when immersed in water;

control means, mounted within the housing and connected to the electrical power source, an automatic actuating means and the sensor means, for activating said automatic actuating means in response to the output signal from the water sensor means;

a ram movably mounted within the housing and movable between a first, retracted position and a second, extended position acting on the plunger to drive the plunger into the canister;

a first biasing means for biasing the ram toward the second position; and said automatic actuating means, responsive to the control means when an output signal is received from the water sensor means, for actuating the ram to move to the second position under the bias of the first biasing means, and resettable for re-latching the ram in the first position after the ram has moved to the second position and returned to the first position.

2. The inflator of claim 1 wherein the automatic actuating means comprises:

latching means for latching the ram in the first position.

3. The inflator of claim 2 wherein the latching means comprises:

a slider member mounted within the housing and movable between a first position blocking movement of the ram and a second position unlatching the ram for movement.

4. The inflator of claim 1 further including:

second biasing means, mounted in the housing, for normally biasing the plunger toward the canister such that the piercing end of the canister contacts the canister when a sealed canister is inserted into the housing.

5. The inflator of claim 1 further comprising:

manual actuating means for urging the plunger towards the canister such that the piercing end of the plunger pierces the canister and releases the pressurized gas therefrom.

6. The inflator of claim 5 wherein the manual actuating means comprises:

lanyard having a first end movably extending from the housing and a second end pivotally mounted within the housing; and a cam shape formed on the lanyard and acting on the plunger to urge the plunger into the canister when the first end of the lanyard is extended from the housing.

7. The inflator of claim 1 further comprising:

means for sealingly removably attaching a gas canister to the housing.

8. An inflator for inflatable articles comprising:

a housing;

means, formed in the housing, for discharging gas therefrom;

a pressurized gas canister attached to the housing and disposed in fluid flow communication with the gas discharging means;

a plunger movably mounted within the housing with respect to and facing the canister, the plunger having a canister piercing end;

an electrical power source mounted within the housing;

water sensor means, mounted on the housing and extending partially outward therefrom, for generating an output signal when immersed in water;

control means, mounted within the housing and connected to the electrical power source, an automatic actuating means and the sensor means, for activating said automatic actuating means in response to the output signal from the water sensor means;

a ram movably mounted within the housing and movable between a first, retracted position and a second, extended position acting on the plunger to drive the plunger into the canister;

a first biasing means for biasing the ram toward the second position; and said automatic actuating means, resettable and responsive to the control means when an output signal is received from the water sensor means, for actuating the ram to move to the second position under the bias of the first biasing means, the automatic actuating means including:

a slider member mounted within the housing and movable between a first position blocking movement of the ram and a second position unblocking the ram for movement, the slider member having gear teeth formed thereon;

motor means, responsive to the control means, and having a rotatable output shaft; and gear means, coupling the motor output shaft to the gear teeth on the slider member, for moving the slider member between the first and second positions upon actuation of the motor means.

9. An inflator for inflatable articles comprising:

a housing;

means, formed in the housing, for discharging gas therefrom;

a pressurized gas canister attached to the housing and disposed in fluid flow communication with the gas discharging means;

a plunger movably mounted within the housing with respect to and facing the canister, the plunger having a canister piercing end;

an electrical power source mounted within the housing;

water sensor means, mounted on the housing and extending partially outward therefrom, for generating an output signal when immersed in water;

control means, mounted within the housing and connected to the electrical power source, an automatic actuating means and the sensor means, for activating said automatic actuating means in response to the output signal from the water sensor means;

a ram movably mounted within the housing and movable between a first, retracted position and a second, extended position acting on the plunger to drive the plunger into the canister;

a first biasing means for biasing the ram toward the second position;

said automatic actuating means, resettable and responsive to the control means when an output signal is received from the water sensor means, for actuating the ram to move to the second position under the bias of the first biasing means; and first detector means, mounted within the housing, for detecting the attachment of a sealed canister to the housing, the first detector means being input to the control means.

10. The inflator of claim 9 further comprising:

a first status indicator, mounted in the housing and responsive to the control means and the first detector means, for indicating a pierced condition of the canister.

11. An inflator for inflatable articles comprising:

a housing;

means, formed in the housing, for discharging gas therefrom;

a pressurized gas canister attached to the housing and disposed in fluid flow communication with the gas discharging means;

a plunger movably mounted within the housing with respect to and facing the canister, the plunger having a canister piercing end;

an electrical power source mounted within the housing;

water sensor means, mounted on the housing and extending partially outward therefrom, for generating an output signal when immersed in water;

control means, mounted within the housing and connected to the electrical power source, an automatic actuating means and the sensor means, for activating said automatic actuating means in response to the output signal from the water sensor means;

a ram movably mounted within the housing and movable between a first, retracted position and a second, extended position acting on the plunger to drive the plunger into the canister;

a first biasing means for biasing the ram toward the second position;

said automatic actuating means, resettable and responsive to the control means when an output signal is received from the water sensor means, for actuating the ram to move to the second position under the bias of the first biasing means; and second detector means, mounted within the housing, for detecting the ram in the second, retracted position, the second detector means being input to the control means.

12. An inflator for inflatable articles comprising:

a housing;

means, formed in the housing, for discharging gas therefrom;

a pressurized gas canister attached to the housing and disposed in fluid flow communication with the gas discharging means;

a plunger movably mounted within the housing with respect to and facing the canister, the plunger having a canister piercing end;

an electrical power source mounted within the housing;

water sensor means, mounted on the housing and extending partially outward therefrom, for generating an output signal when immersed in water;

a ram movably mounted within the housing and movable between a first, retracted position and a second, extended position acting on the plunger to drive the plunger into the canister;

a first biasing means for biasing the ram toward the second position;

resettable automatic actuating means for actuating the ram to move to the second position under the bias of the first biasing means;

a central processing unit, mounted within the housing and connected to the electrical power source, the automatic actuating means and the water sensor means and executing a stored control program, the central processing unit being responsive to the output signal of the water sensor means for activating the automatic actuating means when the water sensor means is immersed in water, and status indicator means, mounted within the housing and responsive to the central processing unit, for indicating the operative state of the inflator.

13. The inflator of claim 12 further including:

first detector means, mounted within the housing, for detecting the attachment of a sealed canister to the housing and generating an attachment signal, the attachment signal being input to the central processing unit.

14. The inflator of claim 12 further including:

second detector means, mounted within the housing, for detecting a pierced canister mounted in the housing and generating a pierced signal, the pierced signal being input to the central processing unit.

15. The inflator of claim 12 further including:

first detector means, mounted within the housing, for detecting the attachment of a sealed canister to the housing and generating an attachment signal, the attachment signal being input to the central processing unit; and second detector means, mounted within the housing, for detecting a pierced canister mounted in the housing and generating a pierced signal, the pierced signal being input to the central processing unit.

16. An inflator for inflatable articles comprising:

a housing;

means, formed in the housing, for discharging gas therefrom;

a pressurized gas canister attached to the housing and disposed in fluid flow communication with the gas discharging means;

a plunger movably mounted within the housing with respect to and facing the canister, the plunger having a canister piercing end;

an electrical power source mounted within the housing;

water sensor means, mounted on the housing and extending partially outward therefrom, for generating an output signal when immersed in water;

control means, mounted within the housing and connected to the electrical power source, an automatic actuating means and the sensor means, for activating said automatic actuating means in response to the output signal from the water sensor means;

a ram movably mounted within the housing and movable between a first, retracted position and a second, extended position acting on the plunger to drive the plunger into the canister;

a first biasing means for biasing the ram toward the second position;

said automatic actuating means, resettable and responsive to the control means when an output signal is received from the water sensor means, for actuating the ram to move to the second position under the bias of the first biasing means, and status indicator means, mounted within the housing and responsive to the control means, for indicating the operative state of the inflator.

17. An inflator for inflatable articles comprising:

a housing;

means, formed in the housing, for discharging gas therefrom;

a pressurized gas canister attached to the housing and disposed in fluid flow communication with the gas discharging means;

a plunger movably mounted within the housing with respect to and facing the canister, the plunger having a canister piercing end;

an electrical power source mounted within the housing;

water sensor means, mounted on the housing and extending partially outward therefrom, for generating an output signal when immersed in water;

control means, mounted within the housing and connected to the electrical power source, an automatic actuating means and the sensor means, for activating said automatic actuating means in response to the output signal from the water sensor means;

a ram movably mounted within the housing and movable between a first, retracted position and a second, extended position acting on the plunger to drive the plunger into the canister;

a first biasing means for biasing the ram toward the second position;

said automatic actuating means, resettable and responsive to the control means when an output signal is received from the water sensor means, for actuating the ram to move to the second position under the bias of the first biasing means, and a second status indicator, responsive to power level of the electrical power source, for indicating a power level below a predetermined magnitude.

18. An inflator for inflatable articles comprising:

a housing;

means, formed in the housing, for discharging gas therefrom;

a pressurized gas canister attached to the housing and disposed in fluid flow communication with the gas discharging means;

a plunger movably mounted within the housing with respect to and facing the canister, the plunger having a canister piercing end;

an electrical power source mounted within the housing;

water sensor means, mounted on the housing and extending partially outward therefrom, for generating an output signal when immersed in water;

control means, mounted within the housing and connected to the electrical power source, an automatic actuating means and the sensor means, for activating said automatic actuating means in response to the output signal from the water sensor means;

a ram movably mounted within the housing and movable between a first, retracted position and a second, extended position acting on the plunger to drive the plunger into the canister;

a first biasing means for biasing the ram toward the second position;

said automatic actuating means, resettable and responsive to the control means when an output signal is received from the water sensor means, for actuating the ram to move to the second position under the bias of the first biasing means;

third biasing means, mounted in the housing, for biasing the ram to the first retracted position; and cap means, threadingly mounted on the housing and engaging the first biasing means, for urging the first biasing means toward the ram when threaded onto the housing and, when unthreaded a predetermined amount, for enabling the third biasing means to bias the ram to the first, retracted position to reset the ram for a subsequent operation.

19. An inflator for inflatable articles comprising:

a housing;

means, formed in the housing, for discharging gas therefrom;

a pressurized gas canister attached to the housing and disposed in fluid flow communication with the gas discharging means;

a plunger movably mounted within the housing with respect to and facing the canister, the plunger having a canister piercing end;

an electrical power source mounted within the housing;

water sensor means, mounted on the housing and extending partially outward therefrom, for generating an output signal when immersed in water;

control means, mounted within the housing and connected to the electrical power source, an automatic actuating means and the sensor means, for activating said automatic actuating means in response to the output signal from the water sensor means;

a ram movably mounted within the housing and movable between a first, retracted position and a second, extended position acting on the plunger to drive the plunger into the canister;

a first biasing means for biasing the ram toward the second position;

second biasing means, mounted in the housing, for normally biasing the plunger toward the canister such that the piercing end of the canister contacts the canister when a sealed canister is inserted into the housing;

said automatic actuating means, resettable and responsive to the control means when an output signal is received from the water sensor means, for actuating the ram to move to the second position under the bias of the first biasing means, the automatic actuating means comprising:

a slider member mounted within the housing and movable between a first position latching the ram in the ram first retracted position and a second position unlatching the ram for movement;

motor means, responsive to the control means, and having a rotatable output shaft;

the slider member having gear teeth formed thereon; and gear means, coupling the motor output shaft to the gear teeth on the slider member, for moving the slider member between the first and second positions upon actuation of the motor means; and manual actuating means for urging the plunger towards the canister such that the piercing end of the plunger pierces the canister and releases the pressurized gas therefrom.

* * * * *